US006409544B1

(12) United States Patent
Wu

(10) Patent No.: US 6,409,544 B1
(45) Date of Patent: Jun. 25, 2002

(54) NETWORK DATA TRANSMISSION CABLE CONNECTOR

(75) Inventor: Chin Hsing Wu, Taipei (TW)

(73) Assignee: Lorom Industrial Co., Ltd., Taipei (TW)

( * ) Notice: Subject to any disclaimer, the term of this patent is extended or adjusted under 35 U.S.C. 154(b) by 0 days.

(21) Appl. No.: 09/862,518

(22) Filed: May 23, 2001

(51) Int. Cl.[7] ..... H01R 13/648; H01R 11/20; H01R 4/24; H01R 4/26

(52) U.S. Cl. ..... 439/608; 439/418; 439/944

(58) Field of Search ..... 439/607, 608, 439/418, 676, 344, 944; 179/27

(56) References Cited

U.S. PATENT DOCUMENTS 4,824,383 A * 4/1989 Lemke ..... 439/108
5,057,038 A * 10/1991 Bowen et al. ..... 439/497
5,063,314 A * 11/1991 DeSantis ..... 310/71
5,586,911 A * 12/1996 Miller et al. ..... 439/607
5,727,962 A * 3/1998 Caveney et al. ..... 439/344
5,766,043 A * 6/1998 Talend ..... 439/676
5,830,015 A * 11/1998 Rodrigues et al. ..... 439/608
5,842,887 A * 12/1998 Andrews ..... 439/608
5,899,770 A * 5/1999 Ezawa ..... 439/418
6,077,122 A * 6/2000 Elkhatib et al. ..... 439/608
6,080,007 A * 6/2000 Dupuis et al. ..... 439/418
6,099,345 A * 8/2000 Milner et al. ..... 439/460
6,280,232 B1 * 8/2001 Beecher et al. ..... 439/418

* cited by examiner

*Primary Examiner*—P. Austin Bradley
*Assistant Examiner*—Edwin A. León
(74) *Attorney, Agent, or Firm*—Jones, Tullar & Cooper, P.C.

(57) ABSTRACT

A network data transmission cable connector is constructed to include a connector plug, a plastic conductor holder block and a metal shield respectively mounted in the connector plug and adapted to guide the electrically insulated conductors of the twisted pairs of a cable into contact with respective metal terminals in the connector plug, the metal shield having a corrugated configuration adapted to separate the twisted pairs of the cable, for enabling the first, second and third twisted pairs of the cable to be separately supported above the metal shield and the two electrically insulated conductors of the fourth twisted pair of the cable to be separately supported below the metal shield.

3 Claims, 5 Drawing Sheets

NETWORK DATA TRANSMISSION CABLE CONNECTOR

BACKGROUND OF THE INVENTION

The present invention relates to electric connectors and, more specifically, to a network data transmission cable connector for connection between a cable and a modem.

Twisted pairs, coaxial cables, and fiber optical cables are commonly used as data transmission media for data transmission between transmitter means and receiver means.

A twisted pair includes two electrically insulated conductors arranged together in a spiral form. It can be used as a communication chain. As illustrated in FIG. 1, a network transmission cable 50 is comprised of a cable 51, and two connectors 52. The cable 51 is comprised of multiple twisted pairs 53 (for example, four twisted pairs as shown in FIG. 2) arranged in parallel, and a protective sleeve 54 covering the twisted pairs 53. The connectors 52 are respectively connected to the two ends of cable 51 for enabling the cable 51 to be connected between two communication apparatus. It is well known that arranging electrically insulated conductors 59 in twisted pairs 53 greatly reduces electromagnetic interference between the electrically insulated conductors 59. However, the lead ends and tail ends of the electrically insulated conductors 59 of the twisted pairs 53 must be maintained straight, so that the electrically insulated conductors 59 can be respectively inserted into the respective connectors 52, and the respective terminals 55 of the connectors 52 can pierce through the insulator of the respective electrically insulated conductors 59 to make a respective electric contact (see FIG. 4). Because the lead ends and tail ends of the electrically insulated conductors 59 of the twisted pairs 53 are maintained straight in the connectors 52, electromagnetic interference exists in the connectors 52.

In order to eliminate the aforesaid electromagnetic interference problem, an improved structure of connector 52 is developed. This improved structure of connector 52, as shown in FIG. 2, comprises a connector plug 60, and a plastic conductor holder 56. The connector plug 60 comprises a backwardly extended mounting chamber 61, a back opening 62 on the back side thereof through which the plastic conductor holder 56 is inserted into the mounting chamber 61, a plurality of horizontal conductor slots 64 respectively forwardly extended from the mounting chamber 61 and adapted to receive the electrically insulated conductors 59 of the twisted pairs 53 of the cable 51, a plurality of vertical terminal slots 63 respectively disposed at the front side thereof in communication with the conductor slots 64, and a plurality of metal terminals 55 respectively mounted in the vertical terminal slots 63. The plastic conductor holder 56 holds the electrically insulated conductors 59 of the twisted pairs 53 of the cable 51 in the mounting chamber 61 of the connector plug 60, comprising a back opening 57, which receive the twisted pairs 53 of the cable 51, and parallel conductor slots 58, which receive the electrically insulated conductors 59 of the twisted pairs 53 of the cable 51 respectively, for enabling the electrically insulated conductors 59 of the twisted pairs 53 of the cable 51 to be respectively inserted into the conductor slots 64 of the connector plug 60 upon insertion of the plastic conductor holder 56 with the twisted pairs 53 of the cable 51 into the mounting chamber 61 of the connector plug 60, so that the metal terminals 55 can pierce through the insulator of each electrically insulated conductor 59 of the twisted pairs 53 of the cable 51 to make a respective electric contact (see FIG. 3). Because the lead (or tail) ends of the electrically insulated conductors 59 of the twisted pairs 53 of the cable 51 are kept straight for contact with the metal terminals 55 respectively, electromagnetic interference exists in the straight lead (or tail) ends of the electrically insulated conductors 59 of the twisted pairs 53 of the cable 51. Furthermore, because the conductor holder 56 is molded from plastics, it cannot protect the electrically insulated conductors 59 of the twisted pairs 53 of the cable 51 against electromagnetic interference.

SUMMARY OF THE INVENTION

The present invention has been accomplished under the circumstances in view. It is the main object of the present invention to provide a network data transmission cable connector, which minimizes electromagnetic interference between the conductors of the twisted pairs of the cable.

According to one aspect of the present invention, the network data transmission cable connector is adapted to receive the electrically insulated conductors of the twisted pairs of a cable having a protective outer sleeve and 4 twisted pairs in the protective outer sleeve. The network data transmission cable connector comprises a connector plug, a plastic conductor holder block and a metal shield respectively mounted in the connector plug and adapted to guide the electrically insulated conductors of the twisted pairs of a cable into contact with respective metal terminals in the connector plug, the metal shield having a corrugated configuration adapted to separate the twisted pairs of the cable, for enabling the first, second and third twisted pairs of the cable to be separately supported above the metal shield and the two electrically insulated conductors of the fourth twisted pair of the cable to be separately supported below the metal shield.

According to another aspect of the present invention, the conductor holder block comprises eight conductor holes alternatively arranged into two horizontal rows at different elevations for guiding the electrically insulated conductors of the twisted pairs of the cable separately into contact with the respective metal terminals of the connector plug.

DETAILED DESCRIPTION OF THE PREFERRED EMBODIMENT

Figure 1:
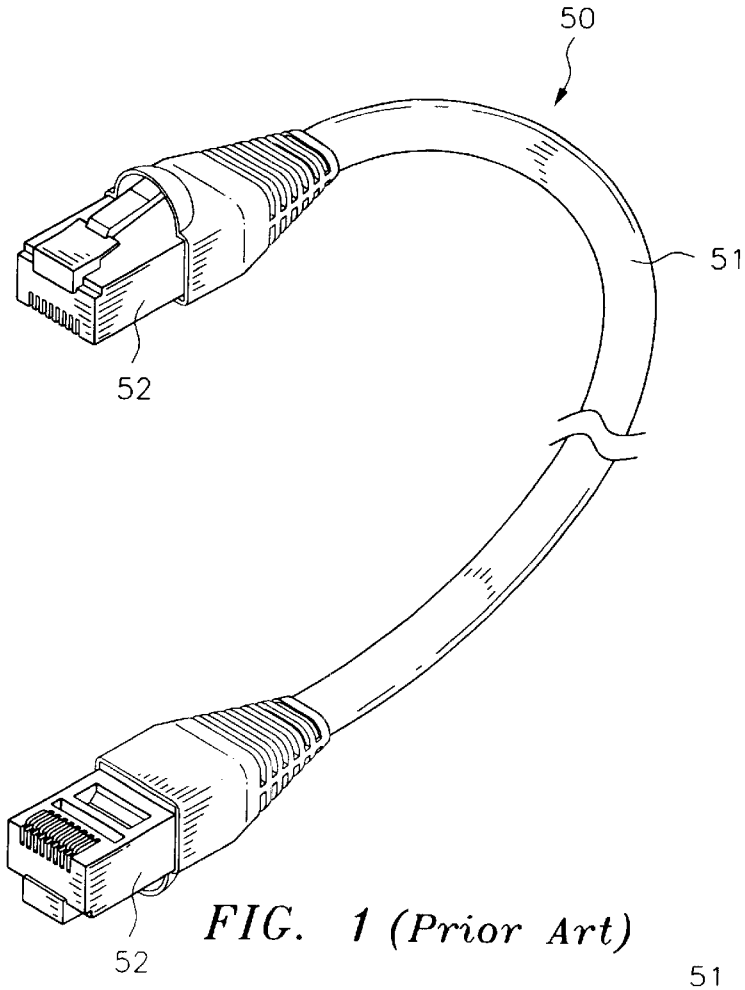
FIG. 1 (Prior Art)
FIG. 1 is a perspective view of a network data transmission cable according to the prior art.
Figure 2:
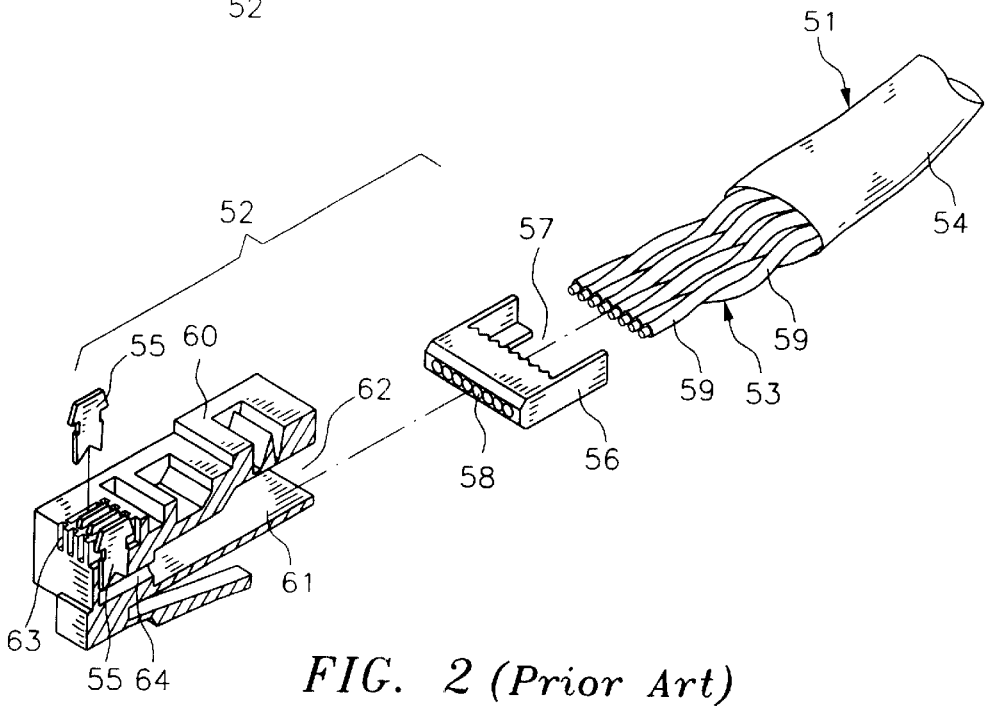
FIG. 2 (Prior Art)
FIG. 2 is an exploded view of the network data transmission cable according to the prior art.
Figure 3:
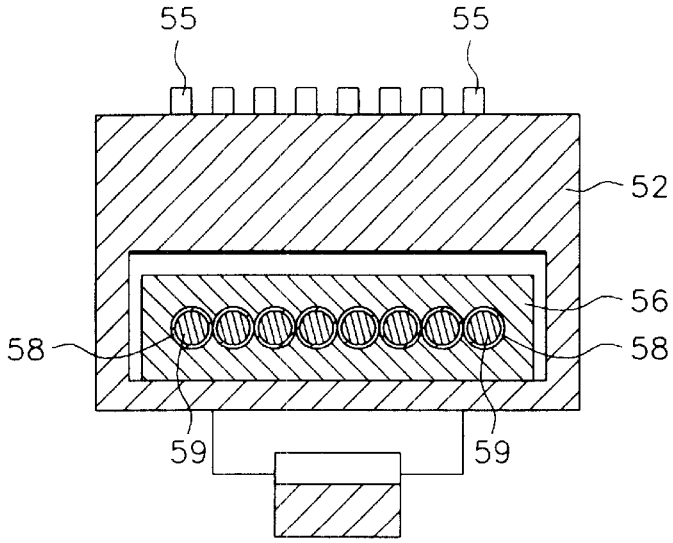
FIG. 3 (Prior Art)
FIG. 3 is a sectional view in an enlarged scale of the connector shown in FIG. 2.
Figure 4:
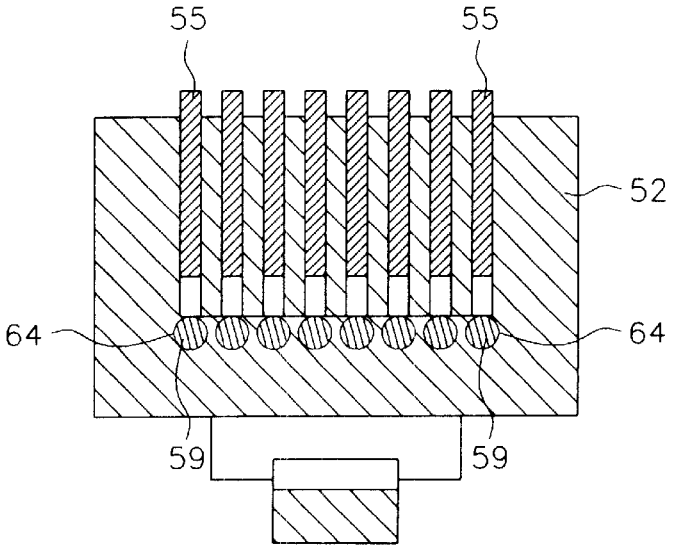
FIG. 4 (Prior Art)
FIG. 4 is another sectional view in an enlarged scale of the connector shown in FIG. 2.
Figure 5:
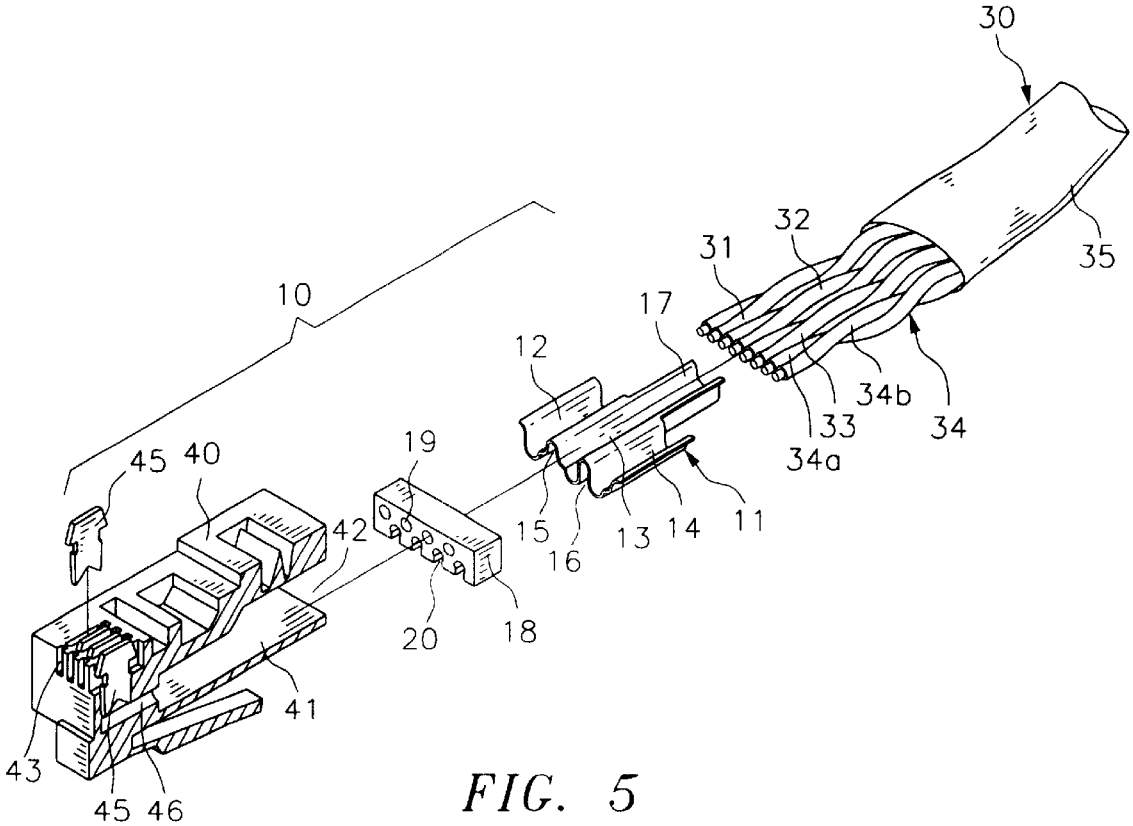
FIG. 5 is an exploded view, partially cutaway of the present invention.
Figure 6:
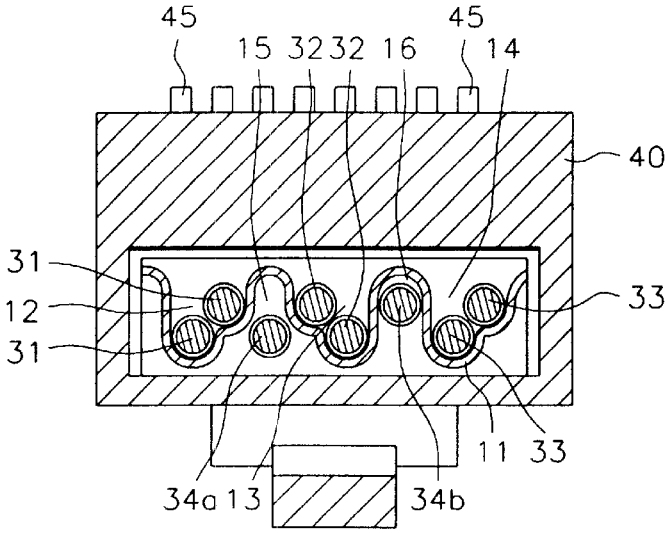
FIG. 6 is a sectional view in an enlarged scale of the present invention.

Referring to FIGS. 5 and 6, a network data transmission cable connector 10 is shown comprised of a connector plug

Figure 8:
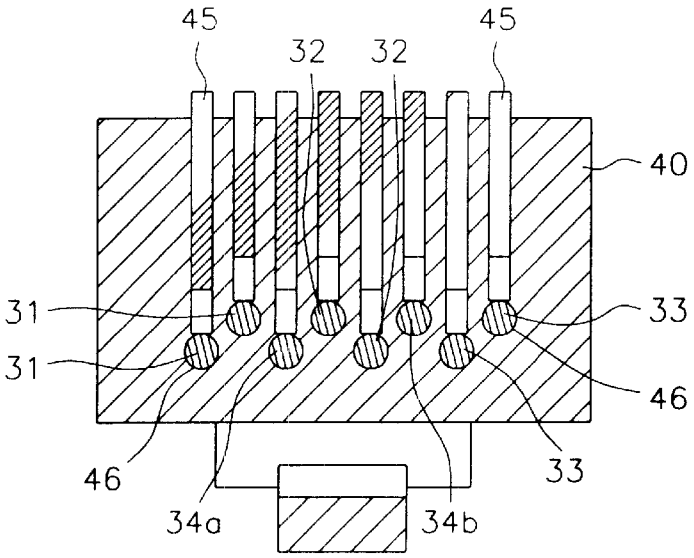
FIG. 8 is still another sectional view in an enlarged scale of the present invention.

40, a conductor holder block 18, and a metal shield 11. The connector plug 40 comprises a backwardly extended mounting chamber 41, a back opening 42 on the back side thereof through which the metal shield 11 and the conductor holder block 18 are inserted into the mounting chamber 41, a plurality of horizontal conductor slots 46 respectively forwardly extended from the mounting chamber 41 and adapted to receive the electrically insulated conductors 34*a*;34*b* of the twisted pairs 31~34 of the cable 30, a plurality of vertical terminal slots 43 respectively disposed at the front side thereof in communication with the conductor slots 46, and a plurality of metal terminals 45 respectively mounted in the vertical terminal slots 43. The horizontal conductor slots 46 are alternatively arranged into two horizontal rows at different elevations (see FIG. 6). After connection of the network data transmission cable connector 10 to the cable 30, the metal terminals 45 respectively pierce the insulator of each of the electrically insulated conductors 34*a*;34*b* of the twisted pairs 31~34 of the cable 30 to make a respective electric contact (see FIG. 8). The metal shield 11 is a thin sheet of metal mounted in the mounting chamber 41 of the connector plug 40 to separate the twisted pairs 31~34 of the cable 30, i.e., to let a part of the twisted pairs 31~34 of the cable 30 be supported on the top side of the metal shield 11 and the other part of twisted pairs 31~34 of the cable 30 be arranged at the bottom side of the metal shield 11. According to the present preferred embodiment, the metal shield 11 is a thin sheet of metal stamped into a corrugated configuration defining three parallel grooves, namely, the first longitudinal groove 12, the second longitudinal groove 13 and the third longitudinal groove 14 on the top side thereof adapted to receive the first twisted pair 31, second twisted pair 32 and third twisted pair 33 of the cable 30 respectively, and two parallel grooves, namely, the fourth longitudinal groove 15 and the fifth longitudinal groove 16 on the bottom side thereof adapted to receive the two electrically insulated conductors 34*a*;34*b* of the fourth twisted pair 34 of the cable 30. Because the first twisted pair 31, second twisted pair 32 and third twisted pair 33 of the cable 30 are respectively separated from one another by the first longitudinal groove 12, second longitudinal groove 13 and third longitudinal groove 14 of the metal shield 11 and the two electrically insulated conductors 34*a*;34*b* of the fourth twisted pair 34 are separated from each other by the fourth longitudinal groove 15 and fifth longitudinal groove 16 of the metal shield 11, electromagnetic interference in the network data transmission cable connector 10 is minimized. The metal shield 11 further comprises rear extension 17 backwardly extended from the middle part thereof (the rear end of the second longitudinal groove 13) for insertion into the protective sleeve 35 of the cable 30 to secure the metal shield 11 positively to the cable 30.

Figure 7:
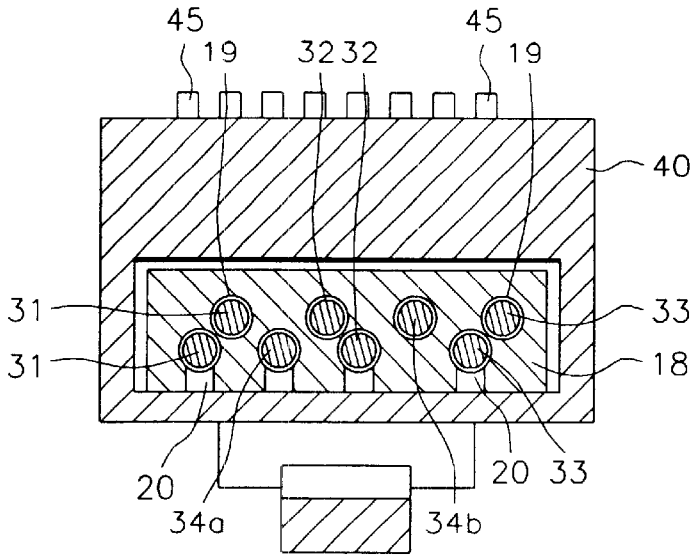
FIG. 7 is another sectional view in an enlarged scale of the present invention.

Referring to FIGS. 5 and 7, the conductor holder block 18 is a rectangular block molded from plastics, comprising eight conductor holes 19;20 alternatively arranged into two horizontal rows at different elevations and adapted to receive the electrically insulated conductors of the twisted pairs 31~34 of the cable 30, for enabling the electrically insulated conductors of the twisted pairs 31~34 of the cable 30 to be respectively inserted into the conductor slots 46 of the connector plug 40. The conductor holes 19;20 can be made having any of a variety of forms. For example, the conductor holes 19 at the upper elevation can be open holes horizontally extended through front and back sidewalls of the conductor holder block 18 and vertically extended through the top sidewall of the conductor holder block 18, and the conductor holes 20 at the lower elevation can be open holes horizontally extended through front and back sidewalls of the conductor holder block 18 and vertically extended through the bottom sidewall of the conductor holder block 18.

Figure 9:
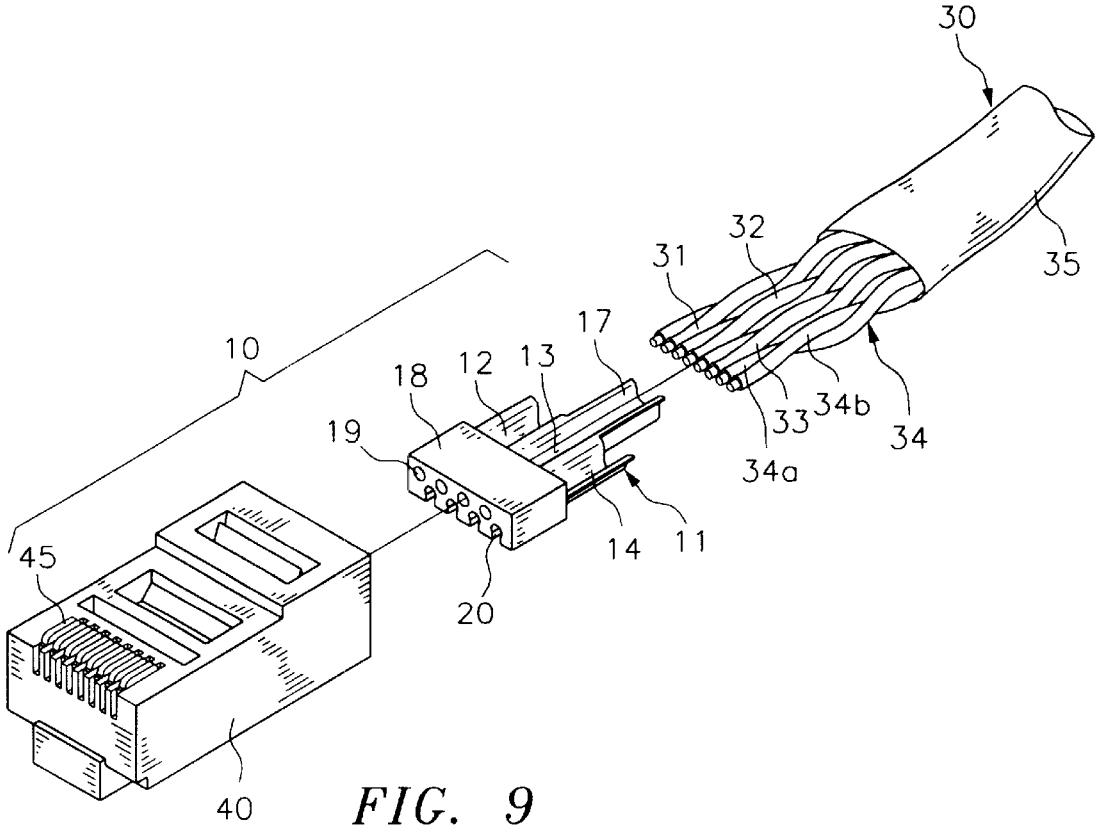
FIG. 9 is an exploded view of an alternate form of the present invention.
Figure 10:
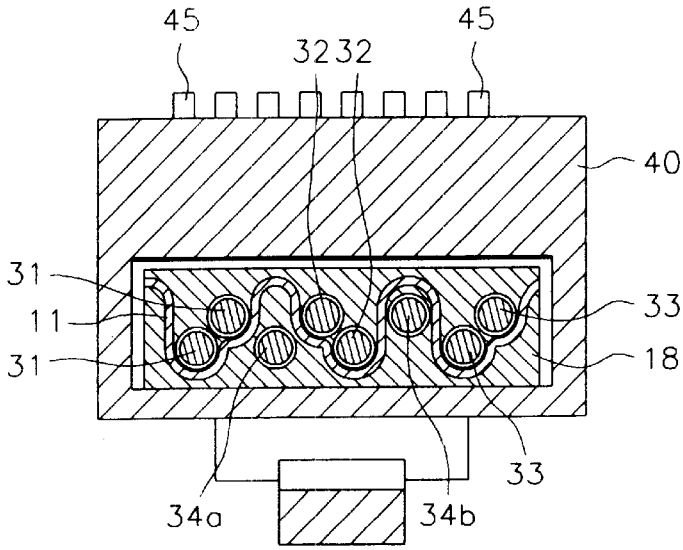
FIG. 10 is a sectional view in an enlarged scale of the embodiment shown in FIG. 9.

In the embodiment shown in FIG. 5, the conductor holder block 18 and the metal shield 11 are separately installed in the connector plug 40. As an alternate form of the present invention, the conductor holder block 18 can be directly molded on the front side of the metal shield 11 (see FIGS. 9 and 10).

A prototype of network data transmission cable connector has been constructed with the features of FIGS. 5~10. The network data transmission cable connector functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A network data transmission cable connector adapted to receive electrically insulated conductors of twisted pairs of a cable having a protective outer sleeve and 4 twisted pairs in the protective outer sleeve, comprising:

a connector plug, said connector plug comprising a backwardly extended mounting chamber adapted to receive the twisted pairs of the cable, a back opening through which the twisted pairs of the cable are inserted into said mounting chamber, a plurality of horizontal conductor slots respectively forwardly extended from said mounting chamber and adapted to receive the electrically insulated conductors of the twisted pairs of the cable respectively, said horizontal conductor slots being alternatively arranged into two horizontal rows at different elevations, and a plurality of vertical terminal slots respectively disposed at a front side thereof in communication with said conductor slots;

a metal shield mounted inside said mounting chamber of said connector plug and separating the twisted pairs of the cable into an upper part supported above said metal shield and a lower part arranged below said metal shield;

a conductor holder block mounted inside said mounting chamber of said conductor plug and disposed in front of said metal shield and adapted to guide the electrically insulated conductors of the twisted pairs of the cable into the conductor slots of said connector plug, said conductor holder block comprising an upper horizontal row of conductor holes and a lower horizontal row of conductor holes alternatively arranged at different elevations for the passing of the electrically insulated conductors of the twisted pairs of the cable; and a plurality of metal terminals respectively mounted in said vertical terminal slots and adapted to pierce the insulation of each of the electrically insulated conductors of the twisted pairs of the cable to make a respective electric contact, wherein said metal shield comprises a first longitudinal groove, a second longitudinal groove, and a third longitudinal groove respectively disposed on a top sidewall thereof and adapted to receive the first, second and third twisted pairs of the cable respectively, a fourth longitudinal groove and a fifth longitudinal groove respectively disposed on a bottom sidewall thereof and receiving the two electrically insulated conductors of a fourth twisted pair of the cable.

2. The network data transmission cable connector of claim 1 wherein said metal shield further comprises a rear extension backwardly extended from a middle part thereof for insertion into the outer protective sleeve of the cable to secure said metal shield to the cable.

3. The network data transmission cable connector of claim 1 wherein said metal shield further comprises a rear extension backwardly extended from said second longitudinal groove for insertion into the outer protective sleeve of the cable to secure said shield to the cable.

* * * * *